US005279626A

United States Patent [19]

Cunningham et al.

[11] Patent Number: 5,279,626

[45] Date of Patent: Jan. 18, 1994

[54] ENHANCED FUEL ADDITIVE CONCENTRATE

[75] Inventors: Lawrence J. Cunningham, Kirkwood, Mo.; Tim Brennan, Collinsville, Ill.

[73] Assignee: Ethyl Petroleum Additives Inc., Richmond, Va.

[21] Appl. No.: 892,024

[22] Filed: Jun. 2, 1992

[51] Int. Cl.[5] ..... C10L 1/22

[52] U.S. Cl. ..... 44/331; 44/451

[58] Field of Search ..... 44/451, 331

[56] References Cited

U.S. PATENT DOCUMENTS 3,474,151 10/1969 Grane ..... 44/451

5,169,410 12/1992 Wright ..... 44/415

*Primary Examiner*—Jacqueline V. Howard

*Attorney, Agent, or Firm*—David E. LaRose

[57] ABSTRACT

This invention relates to a method for enhancing a fuel additive package so as to improve the shelf-life of the package comprising forming a fuel additive package containing (i) a major amount of detergent/dispersant and (ii) a minor amount of demulsifier; and admixing a solvent stabilizer composition with said additive package in an amount sufficient to improve the shelf-life of the fuel additive package.

18 Claims, No Drawings

ENHANCED FUEL ADDITIVE CONCENTRATE

BACKGROUND

This invention relates to a method and composition for hydrocarbonaceous fluid additive concentrates which provide enhanced shelf-life stability.

Detergent/dispersant compositions are typically a major component of many hydrocarbonaceous fluid additive packages and are used commercially to reduce the amount of deposits in automotive and diesel engines and engine components. By hydrocarbonaceous fluids is meant any one or more of fuels, including gasoline, diesel, jet fuel, marine fuels, and the like; or lubricants, either natural or synthetic. Detergent/dispersant compositions may be added to such hydrocarbonaceous fluids separately, however, they are generally added as part of an additive package, which package may contain other components such as demulsifiers, corrosion inhibitors, cold starting aids, dyes, metal deactivators, octane improvers, cetane improvers, emission control additives, antioxidants, and the like.

Typically, fuel additive packages containing detergent/dispersant compositions are prepared as concentrates in bulk and are added to fuels in amounts ranging from about 25 to about 500 pounds per thousand barrels of fuel or more as detergent/dispersant. These bulk concentrates, however, do not always remain clear. Components of the additive concentrates tend to separate from the package giving the package a hazy appearance. In order to assure uniform addition of all components of the package to hydrocarbonaceous fluids, it is desirable that the components remain in a substantially homogeneous solution. Thus it is an object of this invention to provide a stable hydrocarbonaceous fluid additive package. It is another object of this invention to provide a means for stabilizing a hydrocarbonaceous fluid additive package for long term storage. Other objects of this invention will be evident from the ensuing description and appended claims.

THE INVENTION

This invention relates, inter alia, to a hydrocarbonaceous fluid additive package, preferably a fuel additive concentrate, characterized by having enhanced shelf-life stability. Fuel additive packages of this invention comprise a major amount of fuel additive detergent/dispersant; a minor amount of demulsifier; and an amount of solvent stabilizer composition sufficient to enhance the shelf-life stability of the fuel additive package. It has been discovered quite surprisingly, that there is a stabilizing interaction between the additive package and the solvent stabilizer composition, which interaction is present when the solvent stabilizer composition is formed from at least two particular solvents and when the ratio of one solvent to the other in the composition is within a particular range.

This discovery has thus provided a formulation and means for enhancing the stability of hydrocarbonaceous fluid additive packages, preferably fuel additive packages, so that the packages remain clear and in substantially homogeneous solution even when stored for long periods of time. Such a homogeneous clear solution assures that substantially all of the components of the additive package are added to the fuel. In contrast, if one or more components of the additive package separate from the solution, as evidenced by a hazy appearance of the additive package, there is no assurance that the component(s) will be added to the fuel in the desired amount. Thus with the use of the methods and compositions of this invention, storage stable additive packages may be obtained for the first time.

In another embodiment, this invention provides a method for enhancing the shelf-life stability of a fuel additive package comprising forming a fuel additive package containing a major amount of detergent/dispersant and a minor amount of demulsifier; and admixing an amount of solvent stabilizer composition with said additive package in an amount sufficient to improve the shelf-life stability of the fuel additive package.

A critical feature of this invention is the use of a solvent stabilizer composition in combination with a hydrocarbonaceous fluid additive package such as a fuel additive package. The solvent stabilizer composition is formed from at least one aromatic hydrocarbon solvent and at least one alkyl or cycloalkyl alcohol. Combinations of more than one aromatic hydrocarbon solvent, and more than one alkyl or cycloalkyl alcohol may also be used.

A wide variety of aromatic hydrocarbon solvents can be used with this invention such as benzene, and alkyl substituted benzene or mixtures thereof. Particularly preferred are mixtures of o-, p-, and m-xylenes, mesitylene, and higher boiling aromatics such as Aromatic 150 which is commercially available from Chemtech. However, other mixtures of aromatic hydrocarbon solvents may also be used.

Useful alkyl or cycloalkyl alcohols are those alcohols having from 2 to 10 carbon atoms. Suitable alcohols therefore include ethanol, propanol, cyclopropanol, butanol, cyclobutanol, pentanol, cyclopentanol, hexanol, cyclohexanol, and the like, or mixtures of two or more of the foregoing. Preferred are the alkyl alcohols having less than about 8 carbon atoms, with n-butanol being the most preferred.

The ratio of the amount of aromatic hydrocarbon solvent to alcohol in the solvent stabilizer composition is a key feature of this invention. While not desiring to be bound by theory, it is believed that a suitable solvent stabilizer composition should contains both polar and non-polar components. Since most additive packages contain detergent/dispersants having both polar and non-polar characteristics, the incorporation of additional non-polar components to the additive package may tend to reduce the solubility of the detergent/dispersant or demulsifier in the solution. By adjusting the stabilizer solvent composition by incorporation of more non-polar material, the solubility of the components of the additive package is greatly improved. Likewise, if the additive package is predominantly polar in nature, addition of non-polar components tends to reduce the solubility of the polar components of the package. To improve the solubility of the polar components in the presence of non-polar components, additional polar solvent should be used. Accordingly, by a simple trial and error procedure, the stability of a wide variety of additive packages can be enhanced by adjusting the amount of polar and non-polar solvents in the solvent stabilizer composition.

In a preferred embodiment, the solvent stabilizer composition used with diesel fuel additive packages containing detergent/dispersants typically contains a major amount of aromatic hydrocarbon solvent and a minor amount of alkyl or cycloalkyl alcohol. By major amount is meant that the solvent stabilizer composition contains more than about 50 percent by weight aromatic hydrocarbon solvent, preferably more than about 70 percent by weight, and most preferably from about 80 to about 90 percent by weight based on the total weight of the solvent stabilizer composition. Accordingly, the alcohol component should be present in an amount less than about 50 percent by weight, preferably less than about 30 percent by weight, and most preferably less than from about 10 to about 20 percent by weight based on the total weight of the solvent stabilizer composition. As indicated previously, the ratio of aromatic hydrocarbon solvent to alcohol can be readily determined by simple experimentation when the polar/non-polar characteristics of the additive package vary significantly from the characteristics of the packages disclosed herein. Thus, this invention can be adapted for use in a wide variety of additive packages for fuels, and may also be useful for enhancing the solubility of additive packages for lubricants.

When combining the aromatic hydrocarbon and alcohol components to form the stabilizer solvent compositions useful with this invention, the sequence of addition of the components is not important. Thus, the aromatic hydrocarbon can be added to the additive package followed by the alcohol component. Likewise, the alcohol component can be added to the package followed by the aromatic hydrocarbon component. The components can also be premixed in the desired proportions and then added to the package all at once. If desired, the components of the stabilizer solvent system can be added essentially simultaneously to a particular additive package. While not preferred, the additive package can be added to one or more of the components of the stabilizer solvent composition. Combinations of any two or more of the foregoing sequences may also be used. To form the compositions of this invention, standard commercially available mixing equipment may be used and the components combined and mixed in a conventional manner.

Detergent/dispersants useful in forming the additive packages of this invention comprise the reaction product of (i) polyamine and (ii) at least one acyclic hydrocarbyl-substituted succinic acylating agent. The polyamine reactant may be one or more alkylene polyamine(s), which polyamines may be linear, branched, or cyclic; or a mixture of linear, branched and/or cyclic polyamines and wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule. A particularly preferred polyamine is a polyamine or mixture of polyamines having from about 3 to 7 nitrogen atoms with tetraethylene pentamine or a combination of ethylene polyamines which approximate tetraethylene pentamine being the most preferred. In selecting an appropriate polyamine, consideration should be given to the compatibility of the resulting detergent/ dispersant with the fuel mixture with which it is mixed.

Ordinarily the most highly preferred polyamine, tetraethylene pentamine, will comprise a commercially available mixture having the general overall composition approximating that of tetraethylene pentamine but which can contain minor amounts of branched-chain and cyclic species as well as some linear polyethylene polyamines such as diethylene triamine and triethylene tetramine.

The acylating agent which is reacted with the polyamine is an acyclic hydrocarbyl-substituted succinic acylating agent in which the substituent contains an average of 50 to 100 (preferably 64 to 80) carbon atoms. It is desirable that the acyclic hydrocarbyl substituted succinic acylating agent have an acid number in the range of 0.7 to 1.1 (preferably in the range of 0.8 to 1.0, and most preferably 0.9).

When preparing the detergent/dispersants of this invention, the molar ratio of acylating agent to polyamine in the reaction product of (i) and (ii) is desirably greater than 1:1. Preferably the molar ratio of acylating agent to polyamine in the reaction product is in the range of about 1.5:1 to about 2.2:1, more preferably from about 1.7:1 to about 1.9:1, and most preferably about 1.8:1.

The acid number of the acyclic hydrocarbyl substituted succinic acylating agent is determined in the customary way—i.e., by titration—and is reported in terms of mg of KOH per gram of product. It is to be noted that this determination is made on the overall acylating agent with any unreacted olefin polymer (e.g., polyisobutene) present.

The acyclic hydrocarbyl substituent of the acylating agent is preferably an alkyl or alkenyl group having the requisite number of carbon atoms as specified above. Alkenyl substituents derived from poly-α-olefin homopolymers or copolymers of appropriate molecular weight (e.g., propene homopolymers, butene homopolymers, $C_3$ and $C_4$ α-olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000.

Acyclic hydrocarbyl-substituted succinic acid or anhydride acylating agents and methods for their preparation and use in the formation of succinimide are well known to those skilled in the art and are extensively reported in the patent literature. See for example the following U.S. Pat. Nos.

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |
| 3,202,678 | 3,361,673 | 4,110,349 |
| 3,215,707 | 3,373,111 | 4,234,435 |
| 3,219,666 | 3,381,022 | |

When utilizing the general procedures such as described in these patents, the important considerations insofar as the present invention is concerned, are to insure that the hydrocarbyl substituent of the acylating agent contain the requisite number of carbon atoms, that the acylating agent have the requisite acid number, that the acylating agent be reacted with the requisite polyethylene polyamine, and that the reactants be employed in proportions such that the resultant succinimide contains the requisite proportions of the chemically combined reactants, all as specified herein. When utilizing this combination of features, detergent/dispersants are formed which possess exceptional effectiveness in controlling or reducing the amount of deposits and exhaust emissions formed during engine operation.

As pointed out in the above listed patents, the acyclic hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

The acylating agent used in producing the detergent/dispersants of this invention is preferably made by reacting a polyolefin of appropriate molecular weight (with or without chlorine) with maleic anhydride. However, similar carboxylic reactants can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The reaction between (i) polyamine and (ii) at least one acyclic hydrocarbyl-substituted succinic acylating agent is generally conducted at temperatures of 80° C. to 200° C., more preferably 140° C. to 180° C., such that a succinimide is formed. These reactions may be conducted in the presence or absence of an ancillary diluent or liquid reaction medium, such as a mineral lubricating oil solvent. Suitable solvent oils include natural and synthetic base oils. The natural oils are typically mineral oils. Suitable synthetic diluents include polyesters, hydrogenated or unhydrogenated poly-α-olefins (PAO) such as hydrogenated or unhydrogenated 1-decene oligomer, and the like. Blends of mineral oil and synthetic oils are also suitable for this purpose. In a particularly preferred embodiment, the reactions are conducted in the presence of a mineral oil such as 100 solvent neutral.

As used herein, the term succinimide is meant to encompass the completed reaction product from components (i) and (ii) and is intended to encompass compounds wherein the product may have amide, amidine, and/or salt linkages in addition to the imide linkage of the type that results from the reaction of a primary amino group and an anhydride moiety.

A wide variety of demulsifiers are available for use in the practice of this invention, including, for example, organic sulfonates, polyoxyalkylene glycols, oxyalkylated phenolic resins, and like materials. Particularly preferred are mixtures of alkylphenol or polyoxyalkylene glycols, and oxyalkylated alkylphenolic resins, such as are available commercially from Petrolite Corporation under the TOLAD trademark. Such demulsifiers include TOLAD 9362, TOLAD 286, and TOLAD 9308.

Other components may be used in the additive package including oxidation inhibitors or antioxidants, corrosion inhibitors, emission control additives, lubricity additives, antifoams, biocides, dyes, octane or cetane improvers, and the like.

Materials useful as corrosion inhibitors in the practice of this invention include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the succinic acids or derivatives thereof represented by the formula:

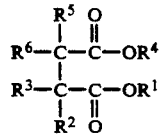

wherein each of $R^2$, $R^3$, $R^5$ and $R^6$ is, independently, a hydrogen atom or a hydrocarbyl group containing 1 to 30 carbon atoms, and wherein each of $R^1$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, and $R^6$ when in the form of hydrocarbyl groups, can be, for example, alkyl, cycloalkyl or aromatic containing groups. Preferably $R^1$, $R^2$, $R^3$, $R^4$ and $R^5$ are hydrogen or the same or different straight-chain or branched-chain hydrocarbon radicals containing 1–20 carbon atoms. Most preferably, $R^1$, $R^2$, $R^3$, $R^4$, and $R^5$ are hydrogen atoms. $R^6$ when in the form of a hydrocarbyl group is preferably a straight-chain or branched-chain saturated hydrocarbon radical.

Most preferred is an alkenyl succinic acid of the above formula wherein $R^1$, $R^2$, $R^3$, $R^4$ and $R^5$ are hydrogen and $R^6$ is a tetrapropenyl group.

The practice of this invention is illustrated by the following non-limiting examples.

EXAMPLE 1

A fuel additive package is prepared by admixing 9 grams of succinimide detergent/dispersant with 0.8 grams of demulsifier and 3 grams of aromatic solvent (Aromatic 150 commercially available from Chemtech) in a 25 mL sample bottle. The admixture is thoroughly stirred and allowed to settle for 10 minutes. After settling, the sample bottle containing the mixture is held up to an incandescent light and is visually observed. In the light, the admixture is dark brown and hazy. Next, 0.6 grams of n-butanol are added to the sample bottle and the mixture is thoroughly agitated. After the mixture is allowed to settle for 10 minutes, the sample is again observed by holding the sample bottle up to an incandescent light. No haze or separation of components is observed.

EXAMPLE 2

Fuel Additive Concentrate Package

A fuel additive package is prepared by mixing 56 pounds per thousand barrels of succinimide detergent/-dispersant, 5 PTB demulsifier, 6 PTB acidic corrosion inhibitor, 5 PTB amine antioxidant, and 0.5 PTB of a metal deactivator.

EXAMPLE 3

The following mixtures of additive package, aromatic solvent, and alcohol were prepared utilizing the additive package illustrated in Example 2:

TABLE I

| Sample # | Package (wt. %) | Aromatic 150 (wt. %) | n-butanol (wt. %) | Temp. (°C.) | Appearance |
|---|---|---|---|---|---|
| 1 | 100 | 0 | 0 | 25 | hazy |
| 2 | 100 | 0 | 0 | 210 | hazy |
| 3 | 75 | 25 | 0 | 25 | hazy |
| 4 | 50 | 50 | 0 | 25 | hazy |
| 5 | 71.4 | 23.8 | 4.8 | 25 | clear |
| 6 | 68.2 | 22.7 | 9.1 | 25 | hazy |
| 7 | 65.2 | 21.7 | 13.0 | 25 | hazy |
| 8 | 60 | 20 | 20 | 25 | hazy |
| 9 | 75 | 23 | 2 | 25 | hazy |
| 10 | 74.3 | 22.8 | 2.9 | 25 | hazy |
| 11 | 73.5 | 22.5 | 3.9 | 25 | clear |
| 12 | 73.5 | 22.5 | 3.9 | 4 | clear |

Variations of the invention are within the spirit and scope of the ensuing claims.

What is claimed is:

1. A fuel additive package characterized by having an enhanced shelf-life stability comprising a) a major amount of detergent/dispersant;

b) a minor amount of demulsifier; and c) an amount of solvent stabilizer composition sufficient to enhance the shelf-life stability of the fuel additive package wherein the solvent stabilizer composition is formed from at least one aromatic hydrocarbon solvent and at least one alkyl or cycloalkyl alcohol and wherein the solvent stabilizer composition contains more than 50 percent by weight aromatic hydrocarbon solvent and from 10 to less than about 50 percent by weight of alcohol.

2. The fuel additive package of claim 1 wherein the solvent stabilizer composition is comprised of $C_4$–$C_6$ alkanol and an aromatic solvent.

3. The fuel additive package of claim 1 wherein the solvent stabilizer composition comprises from about 80 weight percent to about 90 weight percent aromatic solvent and from about 10 weight percent to about 20 weight percent of a $C_4$–$C_6$ alkanol.

4. The fuel additive package of claim 3 wherein the alkanol is n-butanol.

5. The fuel additive package of claim 1 wherein the detergent/dispersant is a reaction product of (i) an alkyl or alkenyl substituted succinic acid or anhydride and (ii) a alkylene-polyamine or mixture of alkylenepolyamines wherein the alkyl or alkenyl group of the substituted succinic acid or anhydride contains from about 10 to about 1000 carbon atoms.

6. The fuel additive package of claim 2 wherein the detergent/dispersant is a reaction product of (i) an alkyl or alkenyl substituted succinic acid or anhydride and (ii) a alkylenepolyamine or mixture of alkylenepolyamines wherein the alkyl or alkenyl group contains from about 10 to about 1000 carbon atoms.

7. The fuel additive package of claim 3 wherein the detergent/dispersant is a reaction product of (i) an alkyl or alkenyl substituted succinic acid or anhydride and (ii) a alkylenepolyamine or mixture of alkylenepolyamines wherein the alkyl or alkenyl group contains from about 10 to about 1000 carbon atoms.

8. The fuel additive package of claim 4 wherein the detergent/dispersant is a reaction product of (i) an alkyl or alkenyl substituted succinic acid or anhydride and (ii) a alkylenepolyamine or mixture of alkylenepolyamines wherein the alkyl or alkenyl group contains from about 10 to about 1000 carbon atoms.

9. The fuel additive package of claim 8 wherein the detergent/dispersant comprises the reaction product of (i) an alkyl or alkenyl substituted succinic acid or anhydride wherein the alkyl or alkenyl group has a number average molecular weight in the range of from about 750 to about 2300 and (ii) a alkylenepolyamine or mixture of alkylenepolyamines approximating tetraethylene pentamine.

10. A method for enhancing the shelf-life stability of a fuel additive package comprising a) forming a fuel additive package containing a major amount of detergent/dispersant and a minor amount of demulsifier; and b) admixing an amount of solvent stabilizer composition with said additive package in an amount sufficient to improve the shelf-life stability of the fuel additive package wherein the solvent stabilizer composition is formed from at least one aromatic hydrocarbon solvent and at least one alkyl or cycloalkyl alcohol and wherein the solvent stabilizer composition contains more than 50 percent by weight aromatic hydrocarbon solvent and from 10 to less than about 50 percent by weight of alcohol.

11. The method of claim 10 wherein the solvent stabilizer composition is comprised of $C_4$–$C_6$ alkanol and an aromatic solvent.

12. The method of claim 10, wherein the solvent stabilizer composition comprises from about 80 weight percent to about 90 weight percent aromatic solvent and from about 10 weight percent to about 20 weight percent of a $C_4$–$C_6$ alkanol.

13. The method of claim 12 wherein the alkanol is n-butanol.

14. The method of claim 10 wherein the detergent/-dispersant is a reaction product of (i) an alkyl or alkenyl substituted succinic acid or anhydride and (ii) a alkylenepolyamine or mixture of alkylenepolyamines wherein the alkyl or alkenyl group of the substituted succinic acid or anhydride contains from about 10 to about 1000 carbon atoms.

15. The method of claim 11 wherein the detergent/-dispersant is a reaction product of (i) an alkyl or alkenyl substituted succinic acid or anhydride and (ii) a alkylenepolyamine or mixture of alkylenepolyamines wherein the alkyl or alkenyl group of the substituted succinic acid or anhydride contains from about 10 to about 1000 carbon atoms.

16. The method of claim 12 wherein the detergent/-dispersant is a reaction product of (i) an alkyl or alkenyl substituted succinic acid or anhydride and (ii) a alkylenepolyamine or mixture of alkylenepolyamines wherein the alkyl or alkenyl group of the substituted succinic acid or anhydride contains from about 10 to about 1000 carbon atoms.

17. The method of claim 13 wherein the detergent/-dispersant is a reaction product of (i) an alkyl or alkenyl substituted succinic acid or anhydride and (ii) a alkylenepolyamine or mixture of alkylenepolyamines wherein the alkyl or alkenyl group of the substituted succinic acid or anhydride contains from about 10 to about 1000 carbon atoms.

18. The method of claim 17 wherein the detergent/-dispersant comprises the reaction product of (i) an alkyl or alkenyl substituted succinic acid or anhydride wherein the alkyl or alkenyl group has a number average molecular weight in the range of from about 750 to about 2300 and (ii) a alkylenepolyamine or mixture of alkylenepolyamines approximating tetraethylene pentamine.

* * * * *